US005576066A

United States Patent [19]

Polti

[11] Patent Number: 5,576,066

[45] Date of Patent: Nov. 19, 1996

[54] METHOD OF IMPROVING THE WEAR AND CORROSION RESISTANCE OF FERROUS METAL PARTS

[75] Inventor: Jean Polti, Sury le Comtal, France

[73] Assignee: Centre Stephanois de Recherches Mecaniques Hydromecanique et Frottement, Andrezieux-Boutheon, France

[21] Appl. No.: 543,033

[22] Filed: Oct. 13, 1995

Related U.S. Application Data

[63] Continuation-in-part of Ser. No. 273,152, Jul. 22, 1994, abandoned.

[30] Foreign Application Priority Data

Aug. 10, 1993 [FR] France ..... 93 09814

[51] Int. Cl.[6] ..... B05D 1/18; C23C 22/70

[52] U.S. Cl. ..... 427/435; 148/242

[58] Field of Search ..... 427/435, 430.1; 148/242

[56] References Cited

U.S. PATENT DOCUMENTS

| | | |
|---|---|---|
| 2,639,244 | 5/1953 | Vordahl et al. . |
| 3,912,547 | 10/1975 | Gaucher et al. . |
| 4,006,043 | 2/1977 | Gaucher et al. . |
| 4,055,446 | 10/1977 | Kunst et al. . |
| 4,292,094 | 9/1981 | Kunst et al. . |
| 4,448,611 | 5/1984 | Grellet et al. . |

FOREIGN PATENT DOCUMENTS

| | | |
|---|---|---|
| 0497663 | 8/1992 | European Pat. Off. . |
| 2171993 | 9/1973 | France . |
| 2271307 | 12/1975 | France . |
| 2306268 | 10/1976 | France . |
| 2463821 | 2/1981 | France . |
| 2525637 | 10/1983 | France . |
| 2-34793 | 2/1990 | Japan . |
| 2056505 | 3/1981 | United Kingdom . |

*Primary Examiner*—Roy V. King
*Attorney, Agent, or Firm*—Young & Thompson

[57] ABSTRACT

A process for improving the wear and corrosion resistance of ferrous metal parts consists in immersing the parts, which have previously been treated using a nitriding, diffusion technique, in a molten salt bath comprising carbonates, nitrates, hydroxides and oxygenated alkali metal salts. The relative anionic proportions by weight of carbonates, nitrates and hydroxides expressed in terms of their sodium salts and corresponding to the active phase, that is the liquid in the bath, are as follows:

$11<CO_3^{2-}<23$ $19<NO_3^{-}<37$ $6<OH^{-}<19$ and the proportion by weight of oxygenated alkali metal salts, expressed in equivalents of $Cr_2O_7^{2-}$ is as follows: 0.05<oxygenated anions<0.41. This process guarantees a high degree of reproducibility of results regardless of the type of treated part.

5 Claims, No Drawings

METHOD OF IMPROVING THE WEAR AND CORROSION RESISTANCE OF FERROUS METAL PARTS

This application is a continuation-in-part of application Ser. No. 08/273,152, filed Jul. 22, 1994, now abandoned.

BACKGROUND OF THE INVENTION

1. Field of the Invention

The present invention concerns a method of improving the wear and corrosion resistance of ferrous metal parts guaranteeing highly reducible results regardless of the type of parts treated.

2. Description of the Prior Art

The great variety of surface treatments is explained in part by the multiplicity of situations with which the technician is faced in industrial practice and by the extreme interdependence of the phenomena causing surface deterioration.

What is more, requirements are becoming ever more severe and an ever greater number of parts must resist loads combining several phenomena, for example, in mechanical engineering: friction, wear, corrosion, even impact and fatigue. In these cases, the conventional methods are found wanting.

Apart from this improvement in performance, under the impulsion of industrial demand, the technician is increasingly concerned with the industrialization of these methods in terms of quality, reliability and reproducibility, in other words with the search for "zero defects".

Thermochemical diffusion treatments are of recognized benefit in improving wear resistance of ferrous metal parts, especially those known as nitriding.

A significant improvement in resistance to wet corrosion can be achieved by growing an oxide surface layer on top of the nitrided layer.

There is an abundant literature on these oxidation treatments. It includes the following patents:

FR-A-2 306 268 of 1976 describes an oxidizing salt bath comprising alkali hydroxides with optionally 2% to 20% by weight alkali nitrate. Preferably employed at temperatures from 200° C. to 300° C., this salt bath is essentially intended for controlled cooling of nitrided ferrous metal parts on leaving a cyanate/cyanide nitriding bath and elimination by oxidation of cyanides entrained with the parts.

FR-A-2 463 821 of 1980 states that the same alkali hydroxide bath, containing 2% to 20% by weight alkali nitrate, significantly increases the corrosion resistance of the nitrided parts if they are immersed in the bath at a temperature between 250° C. and 450° C. for a sufficient length of time, between 15 mins. and 50 mins. A study of this patent, and in particular of its examples, which relate to a bath comprising 37.4% by weight sodium hydroxide, 52.6% by weight potassium hydroxide and 10% by weight sodium nitrate, shows improved resistance to salt spray corrosion, reflected in exposure times prior to the appearance of traces of corrosion that are virtually doubled.

U.S. Pat. No. 4,448,611 to Grellet et al., which corresponds to FR-A-2 525 637 of 1982, describes a method of treating ferrous metal parts containing sulfur in an oxidizing salt bath to improve their corrosion resistance. This document teaches immersion of the parts in an oxidizing bath containing alkali hydroxides, alkali nitrates and/or nitrites and optionally alkali carbonates and additionally 0.5% to 15% by weight of a powerful oxidizing agent, in this instance oxygenated salts of alkali metals whose normal oxy-reduction potential relative to the hydrogen reference electrode is −1 volt or less. The oxygenated salts mentioned are bichromates, permanganates, peroxycarbonates, iodates and periodates, the alkali metals being sodium and potassium. The method described in this patent is further characterized in that a gas containing oxygen is blown into the salt bath and in that the percentage by weight of insoluble particles in the bath is kept below 3%. This method can achieve even better performance. It can improve the corrosion resistance of parts, in this instance by a factor of almost 4, and also does not degrade their resistance to wear and fatigue and can even improve their anti-seizing properties for dry friction.

However, it has become apparent that this performance cannot be achieved in practice with the levels of reliability and reproducibility required by industry. In the laboratory, performance variations are relatively hard to detect. They are much more noticeable when treating industrial size quantities, however. They are particularly apparent when large quantities of small parts must be treated "in bulk", or when treating parts whose surface condition is less than perfect: the presence of imperfections such as pressing and stamping burrs, crimping and bending creases and welding defects are potential corrosion starting sites.

Uneven corrosion resistance is totally unacceptable in the case of parts such as jack piston or damper piston rods and windshield wiper and starter motor spindles for automobiles. The long-standing solution is to adjust the baths from time to time as necessary, according to observed variations in behavior. This solution is unsatisfactory given the industrial requirements as previously explained. This has made it necessary to look for new solutions. We have undertaken an in-depth study which has led to the development of a method which can control on an industrial scale the imponderables previously encountered.

Accordingly, an object of the present invention is a method combining thermochemical diffusion and passivation by oxidation enabling significant improvement in wear and corrosion resistance of ferrous metal parts while guaranteeing a high level of reproducibility and therefore minimal dispersion.

SUMMARY OF THE INVENTION

To this end, the invention proposes a process for improvement of corrosion and wear resistance in ferrous metal parts which have previously been treated using a nitriding, sulfonitriding or carbonitriding thermochemcial diffusion technique, comprising immersing the treated parts in a molten salt bath comprising carbonates, nitrates, hydroxides and oxygenated alkali metal salts, wherein the relative anionic proportions by weight of carbonates, nitrates and hydroxides expressed in terms of their sodium salt equivalents and corresponding to the active phase, that is the liquid in the bath, are as follows:

$11<CO_3^{2-}<23$ $19<NO_3^{-}<37$ $6<OH^{-}<19$ and wherein the proportion by weight of oxygenated alkali metal salts, expressed in equivalents of $Cr_2O_7^{2-}$, is as follows:

0.05<oxygenated anions<0.5, and preferably 0.05<oxygenated anions<0.41.

The invention encompasses any composition containing salts of alkali metals other than sodium, alone or in combination, with percentages when converted into sodium salt equivalents as stated above.

DETAILED DESCRIPTION OF PREFERRED EMBODIMENTS

In the remainder of the description, for easier understanding, all concentrations will be expressed in percentages by weight of equivalent sodium salts, referred to as "sodium units", providing a "norm" for the various mixtures, regardless of the associated metal cation (for example $Na^+$, $K^+$, $Li^+$).

The bath temperature is between 350° C. and 550° C. and preferably between 450° C. and 530° C. and the parts are immersed in the bath for more than ten mins.

It should be noted that the main differences, relating to the process, between the present invention and that of the previously mentioned Grellet et al. U.S. Pat. No. 4,448,611 is the performance of the oxidation.

First of all, the efficiency of the protection of ferrous alloy parts essentially depends on the continuity of the protecting film, i.e. the layer of iron oxide obtained by chemical conversion of nitride. The Science of Materials teaches that upon growth of a layer of a substance, the number and the size of defects depend, to a large extent, on the speed at which this layer builds. If the speed is low enough, numerous germs can be generated, which consequently are small, but which will grow in forming a continuous film. If the speed is too high, a few number of germs will grow excessively to the detriment of others, thus forming large particles, separated by defects, vacuoles, pores, etc . . . In extreme cases, at a very high growing speed, the number of germs is so low, and the defects so numerous, that the substance formed is no longer continuous but takes the appearance of a powder.

The mechanism of action which takes place with the composition claimed by Grellet et al. is as follows. Grellet's bath contains a large—indeed a very large—proportion of oxygenated alkaline salt (strong oxidizing agent). It is saturated with oxygen dissolved by the bubbling of an oxygen-containing gas, and thus has a very high oxidizing power. The effect of this is a quick oxidation, poorly controlled, leading to the formation, at the surface of the treated parts, of a mixture of iron oxide of the magnetite type ($Fe_3O_4$) having a black color, which is the optimum requirement for protection against corrosion, and of the hematite type ($Fe_2O_3$) having reddish brown color, corresponding to the most oxidized state of iron, which is to be avoided. The parts then take an unsettled brownish color, the protection against corrosion is uncertain and leads to a wide dispersion of the results.

On the contrary, the composition claimed in the present invention associates a low proportion of oxygenated alkaline salt and well defined proportions of alkaline nitrates, hydroxides and carbonates. The compositions comprised in the range of the present invention enable the achievement of baths having a moderate oxidizing activity.

From the qualitative point of view, the composition of the invention is of the same type as disclosed in the previously mentioned Grellet et al. U.S. patent. From the quantitative point of view, however, it is clearly distinguished from the latter. This can be explained as follows.

The prime cause of the dispersion previously observed has been found to be the existence of defects of compactness in the nitrided and oxidized layers.

The improvement in wear resistance has been found to be due to the nitrided layer, for the most part, whereas the improvement in corrosion resistance is dependent both on the nitrided layer and on the oxide layer: both provide anodic protection. The effectiveness of this protection is directly dependent on the integrity of the barrier layer: the requirement is for a continuous and impermeable oxide surface layer. The layer which forms in the oxidizing bath is known to consist essentially of $Fe_3O_4$ type iron oxide, which is totally inert. There is thus no possibility of improving the nature of this layer, what is needed being to guarantee its impermeability. It has therefore been important to find a method of obtaining this barrier layer such that the intended result is obtained in all cases, i.e. on all types of parts and on all the parts in the same load or in several successive loads, which is not possible with the prior art baths, as is made clear in the examples described later.

The composition of the oxidizing bath of the present invention is distinguished from the prior art baths by the fact that it combines a substantially lower percentage of the powerfully oxidizing salt than is taught in Grellet et al., in combination with concentrations of nitrates and hydroxides which are also different.

Note that the cation population of the bath is defined only by the nature of the respective metals, i.e. the alkali metals. It is of little importance whether only one or several cations are present and, if there are at least two cations present simultaneously, their relative proportions have little influence on the result.

There is no need further to highlight the complexity of the molten salt baths and the difficulty of understanding the mechanisms operative therein and predicting their behavior by theory based on logical reasoning. The formulation of the bath of the invention and its operating conditions have therefore been determined by means of experiment. The following assessment criteria were adopted to this end: the corrosion resistance of the treated parts, their wear resistance, the fluidity of the bath, the color of the parts and the dispersion of the results.

Carefully selected experiments have shown that the composition of the invention can reconcile all the above criteria.

Although the mechanism operative within the bath has not been elucidated in all respects, it is nevertheless possible to give some indications and to put forward a probable explanation.

Regardless of how it works, the first oxidation thermochemical treatment produces on the surface of the parts a layer comprising mainly nitrides and/or carbonitrides, with minor proportions of free iron, mainly at defects in the underlying layer. It is probably this free iron which is responsible for the poor corrosion resistance of parts that are merely nitrided or carbonitrided.

However, the nitrates are moderately active oxidizing agents and although they are capable of oxidizing the free iron present in the layer they are not sufficiently powerful to destabilize the nitrides or carbonitrides.

On the other hand, a powerful oxidizing agent such as a bichromate, a chromate or a permanganate could oxidize not only the free iron but also some of the nitrides, so producing a more impermeable layer.

Too much oxidizing agent, on the other hand, would make this layer fragile because of residual stresses therein leading to cracks, onset of corrosion and scaling, all prejudicial to its tribological properties. The presence of carbonates would go some way towards moderating these oxidation reactions.

As for the temperature of the bath, below a certain threshold set by the carbonate content of the bath, it is not possible to achieve sufficient fluidity of the molten salts which, in practice, results in high consumption of salts through their removal with the parts, together with considerable settling out at the bottom of the crucible. Excessive temperatures lead to premature deterioration of the bath, with a concomitant reduction in its efficiency.

Finally, note that the oxidation operation, the reactions of which take place in a heterogeneous liquid/solid phase, is operative first and foremost on the outer part of the nitrided, sulfonitrided or carbonitrided layer. The morphology and the porosity of this layer can therefore have a non-negligible influence on the reaction kinetics and intensity levels.

In this regard, in a preferred embodiment of the invention the parts immersed in the oxidizing bath previously undergo thermochemical diffusion with the parameters controlled to form a two-part layer:

a compact part in contact with the substrate and between 6 μm and 12 μm thick, and a finely porous outer part, between 3 μm and 6 μm thick, with a mean pore diameter between 0.1 μm and 2 μm.

The features of the advantages of the invention will emerge more clearly from the following description relating to specific embodiments of the invention and the accompanying examples which, among other things, specify the respective functions of the various constituents of the oxidizing bath.

EXAMPLE 1

Description of a preferred embodiment of the invention and the properties of the treated parts 0.38% carbon non-alloy steel parts were first subjected to sulfonitriding as per patents FR-A-2 171 993 and FR-A-2 271 307 by immersion for 90 mins. in a salt bath containing 37% by weight cyanate ions and 17% by weight carbonate ions, the remainder comprising $K^+$, $Na^+$ and $Li^+$ alkali cations with not more than 10 ppm to 15 ppm of $S^{2-}$ ions. The temperature of the molten salts was 570° C.

On removal from the bath the parts were immersed for 20 mins. in another bath maintained at 475° C. and having the following composition expressed in "sodium units":

$CO_3^{2-}$: 13.1%

$NO_3^-$: 36.5%

$OH^-$: 11.3%

$Cr_2O_7^{2-}$: 0.1%

Na+ equivalent: 39%

The parts were then washed in water at pH 13.5 and dried. Finally, they were characterized by corrosion tests and friction tests.

a) Corrosion tests: the test pieces were 50 mm square plates with varnish protecting the edges. Intensity/potential curves were plotted for an aerated acid medium, yielding the following results:

| Nature of Test Piece | Corrosion (or pitting) Potential (mV/ECS*) |
|---|---|
| Untreated | 130–150 |
| Nitrided only | 175–225 |
| Nitridedd then oxidized by the method of the invention | 1,000–1,300 |

*saturated calomel electrode

Note that for the values of 1,000 Mv/ECS to 1,300 Mv/ECS obtained with the nitrided and then oxidized test pieces the expression "corrosion potential" is somewhat approximate because at this level it is not so much a pitting potential that is measured as the oxidation potential of the aqueous solution: the protection provided by the nitride/oxidized layer is virtually perfect.

b) Friction tests: the test pieces were 35 mm diameter rings and 30 mm×18 mm×8 mm parallelepiped-shape plates. The friction test was conducted dry, by pressing the ring against the larger surface of the plate, with a load progressively increasing from an initial value of 10 daN and with a sliding speed of 0.55 m/s. The results obtained are summarized in the table below:

| Test Piece | Duration (min.) | Cumulative Wear of Both Parts (μm) | Coefficient of Friction |
|---|---|---|---|
| Untreated | 2 | Seizing | Seizing |
| Nitrided only | 30 | 50 | 0.40 |
| Nitrided/oxidized by the invention | 60 | 35 | 0.25 |

EXAMPLE 2

Comparison of the method of the invention with the method described in Grellet et al. U.S. Pat. No. 4,448,611

The comparison was based on two oxidizing baths with a salt capacity of 120 kg, both operating at 460° C. and with the following respective compositions:

| Composition | $CO_3^{2-}$ | $NO_3^-$ | $OH^-$ | $Cr_2O_7^{2-}$ | Na+ Equivalent |
|---|---|---|---|---|---|
| As per Grellet et al. | 6.5 | 24.7 | 20.7 | 4.6 | 43.5 |
| As per invention | 13.1 | 36.5 | 11.3 | 0.1 | 39 |

About ten loads of parts were treated in each bath. The parts were non-alloy steel spindles 10 mm in diameter and 100 mm long having a screw thread at one end. Each load comprise 100 spindles with a total weight of 10 kg.

The other operating conditions (preliminary nitriding, duration of immersion of the parts in the oxidizing bath, final washing/drying operations)were as in Example 1.

The results obtained were qualified against two criteria of reducibility, one based on the color of the parts and the other on their standardized salt spray corrosion resistance.

The color ranged from deep black (the optimum requirement, for reasons of the appearance of the treated parts) to reddish brown (to be avoided).

The results obtained for all the parts treated were as follows:

| Color | As per Grellet et al. | As per invention |
|---|---|---|
| Black | 65% | 95% |
| Brown | 35% | 5% |

As for the corrosion tests, their duration corresponded to the time lapse between insertion of the parts into the salt spray enclosure and the appearance of the first pitting, which was in most cases on the screw-threaded part of the test piece. This area is highly irregular from the metallurgical point of view, leading to numerous imperfections of the nitrided layer, providing many possible sites for corrosion pitting.

The salt spray tests were conducted on samples of five parts from each load and the following results were obtained, after appearance of the first pitting:

| | As per Grellet et al. | As per Invention |
|---|---|---|
| Intervals of variation of exposure times to salt spray to appearance of first pitting (hours) | 10 to 480 | 144 to 504 |
| Mean | 245 | 280 |
| Standard deviation | 220 | 105 |

EXAMPLE 3

Influence of the bichromate or other oxidizing salt content of the oxidizing bath The procedure was as in Example 1, except that the $Cr_2O_7^{2-}$ anion concentration of the oxidizing bath was varied from 0 to 0.16%.

With no bichromate and for any bath temperature between 350° C. and 550° C. there was significant dispersion of the color of the parts between brown and black. Also, in corrosion tests by plotting the intensity/potential curves low corrosion (or pitting) potentials were measured, varying between 100 mV/ECS and 300 mV/ECS, characteristic of the presence of impermeability defects in the passive layer.

Introducing bichromate into the bath made it possible to obtain a regular black coloration of the parts and a concomitant increase in the corrosion potential above 1000 mV/ECS.

The effect commenced at 0.05% $Cr_2O_7^{2-}$ anion in the bath. The optimum was at 0.2% $Cr_2O_7^{2-}$; above 0.2% there was no further improvement up to 0.5%; above 0.5% $Cr_2O_7^{2-}$ the layer is fragile and tends to scale.

The same effects, with the same concentrations, were obtained on replacing the bichromate with permanganate or chromate.

EXAMPLE 4

Influence of the nature of the components of the oxidizing bath

Three tests were carried out, using the procedure of Example 2 and baths with the following compositions:

| Bath | $CO_3^{2-}$ | $NO_3^-$ | $OH^-$ | $Cr_2O_7^{2-}$ | Na+ Equivalent |
|---|---|---|---|---|---|
| No. 1 | 15.6 | 21.7 | 18 | 0.16 | 40.44 |
| No. 2 | 19.4 | 21.8 | 15.1 | 0.09 | 43.61 |
| No. 3 | 5.7 | 21.9 | 25.2 | 0 | 47.2 |

The composition of baths Nos. 1 and 2 was in accordance with the invention, whereas that of bath No. 3 was not.

As in Example 2, the results obtained were qualified by the regularity of the color of the parts treated and by their standardized salt spray corrosion resistance:

| Bath | Percentage of Parts Showing Regular Black Coloration |
|---|---|
| No. 1 | 96% |
| No. 2 | 70% |
| No. 3 | 45% |

With regard to the corrosion tests, batches of five test pieces taken from the loads treated in each of baths Nos. 1 to 3 gave mean times before appearance of the first pitting as summarized in the following table:

| Bath | Mean Time Before Appearance of First Pitting (hours) | Standard Deviation |
|---|---|---|
| No. 1 | 270 | 95 |
| No. 2 | 250 | 120 |
| No. 3 | 120 | 95 |

EXAMPLE 5

Oxidizing Bath Control

An experimental bath was used with the same composition as in Example 1, in which loads of steel parts were treated regularly for several days. The following observations were made:

a) As more loads were treated, the carbonate content of the bath increased. This is because, on leaving the nitriding bath prior to this treatment, the parts entrain salts which are essentially made up of alkali cyanates and carbonates. The cyanates are converted into carbonates by reaction with the oxidizing salts.

When the saturation threshold is exceeded, the carbonates settle out on the bottom of the crucible: they must therefore be removed.

b) The parts also entrain salts on leaving the oxidizing bath. This loss, combined with that associated with the elimination of the carbonates, results in a drop in the level of the oxidizing bath.

c) To top up the level, new salt is added to the bath, i.e. the bath is fed with active nitrates and bichromates (or the equivalent oxygenated salts). This explains why, even if they are present in the bath only in very small quantities, the oxygenated salts do not disappear as the loads of parts are treated, and also explains why their effect is long lasting.

d) Apart from as explained above, the chemical composition of the bath shows little inherent change with time.

EXAMPLE 6

Other Methods of Preliminary Thermochemical Diffusion

If sulfonitriding of steel parts is replaced by nitriding or carbonitriding in a salt bath, the same effects are achieved as already described.

The same applies if the thermochemical diffusion is by the ionic or gaseous path, except that the control of the oxidizing bath is changed compared to what is described for Example 5: there is no longer any entrainment of nitriding salts; the carbonation and the drop in level of the oxidizing bath are therefore slower. To maintain the oxidizing power of the bath constant it is therefore necessary to add oxygenated salt to it periodically, the composition of the bath being checked at regular intervals by analysis.

The following Supplementary Examples 7 to 9 are provided to illustrate the effect of bath composition, temperature and oxidation period.

EXAMPLE 7

Comparative example illustrating the effect of bath composition

Bath No. 1, which is outside the scope of the present invention, is compared to Bath No. 2, according to the present invention.

Bath No. 1: Out of the scope of the present invention $CO_3^{2-}$: 27.17%

$NO_3^-$: 13.85%

$OH^-$: 13.60%

Sodium equivalent: 45.38%

Bath No. 2: According to the present invention $CO_3^{2-}$: 14.15%

$NO_3^-$: 28.98%

$OH^-$: 14.88%

$Cr_2O_7^{2-}$: 0.21%

Sodium equivalent: 41.78%

A load of test parts made of 35CD4, French Standard, steel (0.42% carbon, 1% chromium) was first subjected to usual nitriding in the bath at a temperature of 470° C. during 15 mins.

Concerning Bath No. 1, the viscosity of the bath was high. The treated test parts exhibited a brownish color with mottling. Their corrosion potentials, measured relative to saturated calomel electrode in aerated medium, were dispersed and varied between 210 and 400 mV, which is low.

Concerning Bath No. 2, the bath remained fluid; after treatment, the load of test parts exhibited an intense and uniform black color, the measured corrosion potential was always above 1000 mV, which evidences the immunity against corrosion.

EXAMPLE 8

Effect of Temperature

A load of 35CD4 (French Standard) steel (0.42% carbon, 1% chromium) test parts, previously nitrided by a usual process, were immersed in Bath No. 2 of Example 7 during 15 mins. at temperatures ranging from 310° C. to 570° C.

The results are given hereinbelow.

* at a temperature of 310° C., the viscosity of the bath was high, with the presence of suspended sludges, but in moderate quantities. The treated test parts were black, with brownish spots or coloration zones.

Their corrosion potential, measured under the same conditions as for Example 7, was between 190 and 380 mV, which reflects a poor corrosion resistance.

* at a temperature of 350° C. to 450° C., the bath was fluid; the sludges had completely disappeared and, after treatment, all the test parts exhibited a black uniform color.

Their corrosion potential was in all cases above 1000 mV, which evidences the immunity against corrosion.

* at a temperature of 450° C. to 530° C., the bath was completely fluid, without sludges; its chemical stability was excellent. All the treated pieces exhibited a black uniform color, and their corrosion potential was in the range 1000–1400 mV.

* at a temperature of 550° C., the bath was completely fluid, without sludges, but it aged rapidly due to the higher temperature.

The corrosion potential of the test parts was still in the range 1000–1400 mV.

* at a temperature of 570° C., the treated test parts still exhibited, for most of them, an intense black color, but some of them showed traces of brownish mottling.

Their corrosion potential was in the range of 800 to 1400 mV; the result became more uncertain: a great number of test parts still had an excellent resistance against corrosion but there were some parts which did not possess a satisfactory corrosion resistance.

The bath aged very rapidly.

EXAMPLE 8A (Comparative)

Effect of Temperature on Grellet's Baths

Referring to the state of the art, similar experiments were made using a bath corresponding to that of the previously mentioned Grellet et al. U.S. patent. At any temperature in the range 310° C. to 530° C., the molten bath was fluid, the test pieces were generally of a dark gray color, some of them were brownish.

The average corrosion potential of the pieces was of 600 mV ±200 mV, indicting a moderate improvement of their corrosion resistance.

Above 530° C., the bath was very unstable, the majority of the treated pieces exhibited a reddish color, and their corrosion potential was still above 600 mV. At this temperature, the oxidation behavior of the bath is very strong, probably due to an interaction between the high content of oxidizing agent and the high temperature.

Therefore the oxidation process is no longer uniform, depending on the local conditions.

EXAMPLE 9

Effect of Immersion Time

Test shafts made of 30 CDV 12 (French Standard) alloyed steel containing 0.3% carbon, 3% chromium and minor quantities of molybdenum and vanadium, previously sulfonitrided, were immersed in Bath No. 2 of Example 7 hereinabove, during 5, 10 and 20 mins. The test shafts were then rinsed with water and dried.

Whatever the immersion time was, the shafts exhibited an uniform black color.

The test shafts were then subjected to corrosion resistance tests in saline standardized salt spray. The lifetime is defined by the appearance of the first corrosion pit.

The results were the following:

* First load: immersion time of 5 mins.
  average lifetime: 50 h
  standard deviation: 30 h
* Second load: immersion time of 10 mins.
  average lifetime: 255 h
  standard deviation: 135 h
* Third load: immersion time of 20 mins.
  average lifetime: 270 h
  standard deviation: 120 h A micrographic examination of the shafts thus treated showed that, for an immersion time up to 5 mins., the oxide layer had a low thickness, of about 1 μm.

After 10 mins. of immersion, the layer had a thickness of 3 to 4 μm and was furthermore much more solid.

For an immersion time above 20 mins., the obtained layer was substantially identical to the layer obtained after a treatment of 10 mins., likely showing the existence of an asymptote on the growth kinetics.

It should be readily apparent that the above clearly demonstrates that carrying out the process of the present invention under the specified conditions and parameters, produces new, superior and unexpected results, as compared to the process of Grellet et al. U.S. Pat. No. 4,448,611.

I claim:

1. Process for improvement of corrosion and wear resistance in ferrous metal parts which have previously been treated using a nitriding, sulfonitriding or carbonitriding thermochemical diffusion technique, comprising immersing the treated parts in a molten salt bath having a temperature ranging from 350° C. to 550° C., and comprising carbonates, nitrates, hydroxides and oxygenated alkali metal salts, wherein the relative anionic proportions by weight of carbonates, nitrates and hydroxides expressed in terms of their sodium salt equivalents and corresponding to an active phase, that is the liquid in the bath, are as follows:

$11<CO_3^{2-}<23$ $19<NO_3^-<37$ $6<OH^-<19$ and wherein the proportion by weight of oxygenated alkali metal salts, expressed in equivalents of $Cr_2O_7^{2-}$, is as follows:

0.05<oxygenated anions<0.41, and said step of immersing being carried out for a sufficient period of time to improve the corrosion and wear resistance of said treated parts.

2. Process according to claim 1 wherein the bath temperature is between 450° C. and 530° C.

3. Process according to claim 1 wherein the parts are immersed in the bath for a period which is greater than 10 mins.

4. Process according to claim 1 wherein the oxygenated alkali metal salt is selected form the group consisting of bichromates, chromates, permanganates, peroxycarbonates, iodates and periodates.

5. Process according to claim 1 wherein the thermochemical diffusion is carried out in such a way as to produce on said parts a two-part layer comprising a lower surface layer which has a compact portion having a thickness of between 6 μm and 12 μm and an upper finely porous portion on the outside having a thickness of between 3 μm and 6 μm, with a mean pore diameter being between 0.1 μm and 2 μm.

* * * * *